US006948991B2

(12) United States Patent
Zhao

(10) Patent No.: US 6,948,991 B2
(45) Date of Patent: Sep. 27, 2005

(54) SWIM RING FOR AN INFANT

(75) Inventor: Shaofei Zhao, Guangdong Women and Children Hospital and Health Institute 13 Guangyuan West Road, Guangzhou, Guangdong 510010 (CN)

(73) Assignees: Shaofei Zhao, Guangdong (CN); Kuang-Ta Huang, Hsingchuang (TW)

( * ) Notice: Subject to any disclaimer, the term of this patent is extended or adjusted under 35 U.S.C. 154(b) by 0 days.

(21) Appl. No.: 11/012,775

(22) Filed: Dec. 15, 2004

(65) Prior Publication Data

US 2005/0101204 A1 May 12, 2005

Related U.S. Application Data

(63) Continuation of application No. PCT/CN03/00443, filed on Jun. 6, 2003.

(30) Foreign Application Priority Data

Aug. 15, 2002 (CN) ..... 02272516 U

(51) Int. Cl.[7] ..... B63C 9/13
(52) U.S. Cl. ..... 441/123
(58) Field of Search ..... 441/102–124, 441/40–43, 80, 81, 87; 128/DIG. 20, DIG. 23; 2/468; 602/13, 18

(56) References Cited

U.S. PATENT DOCUMENTS

| | | | | | |
|---|---|---|---|---|---|
| 1,837,089 | A | * | 12/1931 | Wosk | 441/112 |
| 2,210,809 | A | * | 8/1940 | Gray | 441/123 |
| 2,563,122 | A | * | 8/1951 | Morris | 441/112 |
| 2,806,471 | A | * | 9/1957 | Breese | 602/17 |
| 2,869,151 | A | * | 1/1959 | Johnson | 441/96 |
| 3,048,860 | A | * | 8/1962 | Richardson | 441/123 |
| 3,497,889 | A | * | 3/1970 | Filippino et al | 441/118 |
| 3,750,205 | A | * | 8/1973 | Pfeifer | 441/123 |
| 4,800,871 | A | * | 1/1989 | Florjancic | 602/18 |
| 5,334,067 | A | * | 8/1994 | Henry et al. | 441/131 |
| 5,421,760 | A | * | 6/1995 | Blaga | 441/123 |
| 5,502,842 | A | | 4/1996 | Wagner | 2/67 |
| 5,779,512 | A | * | 7/1998 | Rupert | 441/123 |
| 6,230,333 | B1 | * | 5/2001 | Umeda | 2/463 |
| 6,347,971 | B1 | | 2/2002 | Berke et al. | 441/129 |
| 6,389,777 | B1 | * | 5/2002 | Karlsson | 52/741.3 |
| 6,659,825 | B2 | * | 12/2003 | Foss | 441/123 |

FOREIGN PATENT DOCUMENTS

| | | | | |
|---|---|---|---|---|
| CN | 2191593 | | 3/1995 | A47G/9/00 |
| DE | 3227306 | | 1/1984 | B63C/9/18 |
| DE | 19936736 | | 2/2001 | A63B/31/00 |
| GB | 2064337 | | 6/1981 | A63B/31/00 |
| GB | 2123677 | | 2/1984 | A62B/35/00 |
| JP | 56082694 | A * | 7/1981 | B63C/9/16 |
| JP | 02029277 | A * | 1/1990 | A63B/31/12 |
| JP | 2002127986 | A * | 5/2002 | B63C/9/08 |
| JP | 2002264891 | A * | 9/2002 | B63C/9/08 |
| WO | WO2004 037355 | | 5/2004 | |

* cited by examiner

*Primary Examiner*—S. Joseph Morano
*Assistant Examiner*—Ajay Vasudeva
(74) *Attorney, Agent, or Firm*—Alan D. Kamrath; Nikolai & Mersereau, P.A.

(57) ABSTRACT

This invention describes a swim ring for an infant, which is an inflated circular ring. The circular ring comprises an inner ring and an outer ring, and the outer ring is thicker than the inner ring. A cut is formed through the inner ring and the outer ring. A fastener selectively connects the inner ring and the outer ring. The outer ring is a two-part structure. Two air holes are formed in the outer ring, and an inner air chamber of the inner ring communicates with one of the chambers of the outer ring. A recess to hold an infant's chin is formed in the inner ring. This structure allows the inflated circular ring to be attached around an infant's neck and make the infant float perpendicularly in water without restricting movement of the infant's limbs or restricting breathing.

8 Claims, 2 Drawing Sheets

SWIM RING FOR AN INFANT

Continuation of prior application Ser. No.: PCT/CN2003/000443 filed Jun. 6, 2003.

BACKGROUND OF THE INVENTION

1. Field of the Invention

The present invention relates to a swim ring, especially to a swim ring for an infant.

2. Description of the Prior Arts

Presently, swim rings are safety devices for people learning to swim and are suited for people who are developed cognitively and physically enough to mount swim rings around the torso and under the arms. This kind of swim ring is not suited for infants.

SUMMARY OF THE INVENTION

The objective of the present invention is to provide a swim ring for an infant to allow the infant to exercise.

To achieve the objective, a swim ring for an infant in accordance with the present invention is an inflated circular ring. The circular ring comprises an inner ring and an outer ring, and the outer ring is thicker than the inner ring. A cut is formed through the inner ring and the outer ring. A fastener holds the cut in the inner ring and the outer ring. The outer ring is a two-part structure. Two air holes are formed in the outer ring, and the inner air chamber communicates with one of the chambers in the outer ring. A recess to hold an infant's chin is formed in the inner ring.

An improvement of the present invention is multiple colored balls inside the outer ring.

Another improvement of the present invention is to mount a waterproof music player on the outer ring.

Another improvement of the present invention is to mount two handles on the outside of the outer ring.

The inflated circular swim ring with this structure can be attached to an infant's neck and chin, and the infant's chin is held in the recess to make the infant float perpendicularly or at an angle in water, without restricting movement of the infant's limbs or restricting breathing. Thus, it effectively enables an infant's infantile exercises.

DETAILED DESCRIPTION OF THE PREFERRED EMBODIMENTS

Figure 1:
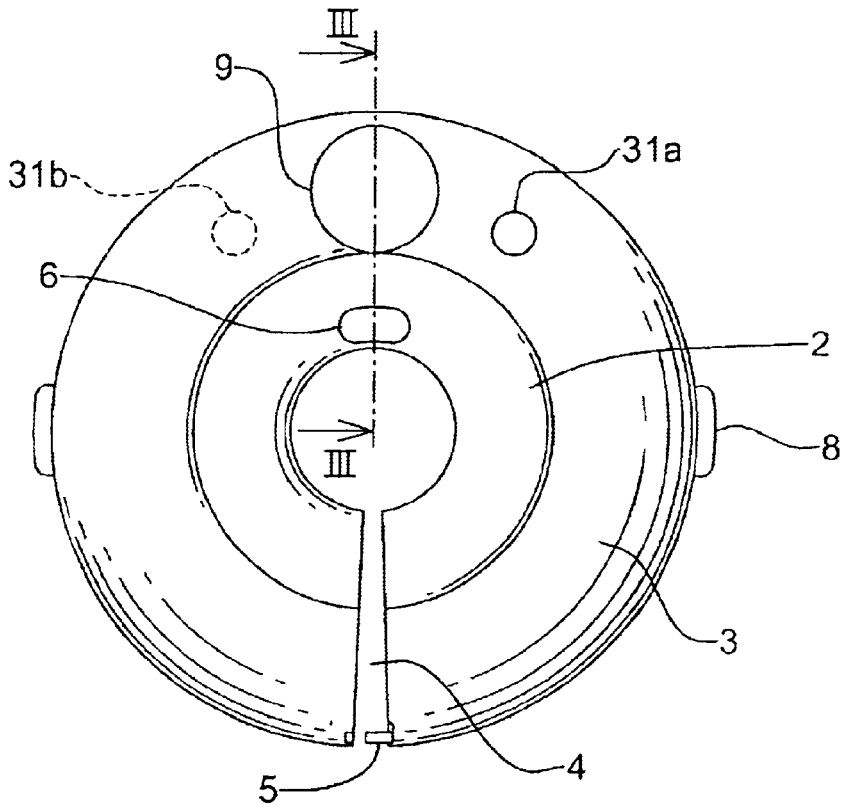
FIG. 1 is a top view of a swim tube for an infant in accordance with the present invention.
Figure 2:
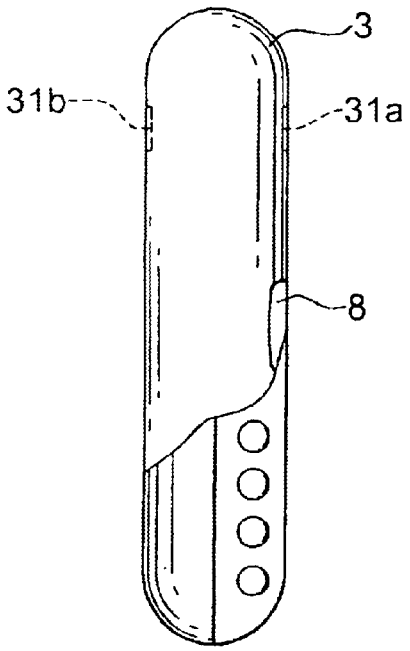
FIG. 2 is a side view in partial section of the swim tube in FIG. 1.
Figure 3:
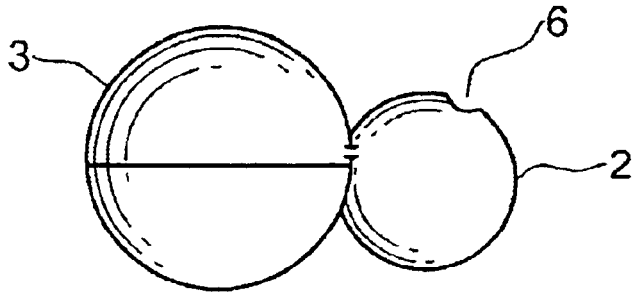
FIG. 3 is a sectional view taken on lines III—III of FIG. 1, with the music player removed from the outer ring.

With reference to FIGS. 1 and 2, a swim tube for an infant in accordance with the present invention is an inflated circular ring (1). The circular ring (1) comprises an inner ring (2) and an outer ring (3), and the outer ring (3) is thicker than the inner ring (2). A cut (4) is formed through the inner ring (2) and the outer ring (3). A fastener (5) holds the cut (4) in the inner ring (2) and the outer ring (3). The inner ring (2) has an inner air chamber. The outer ring (3) is a two-part structure to define two chambers in the outer ring (3). Two air holes (31*a*, 31*b*) are formed in the outer ring (3), and the inner air chamber in the inner ring (2) communicates with one of the chambers in the outer ring (3). A recess (6) to hold an infant's chin is formed in the inner ring (2). Multiple colored balls (7) are inside the outer ring (3). A waterproof music player (9) is mounted on the outer ring (3). Two handles (8) are attached to the outside of the outer ring (3). FIG. 3 shows a sectional view taken on lines III—III of FIG. 1, with the waterproof music player (9) removed from the outer ring. FIG. 3 illustrates two chambers of the outer ring, and a chamber of the inner ring communicating with one of the chambers of the outer ring. During use, the inflated circular ring (1) is attached around the infant's neck, and the infant's chin is held in the recess (6) to make the infant float perpendicularly or at an angle in water without restricting movement of the infant's limbs or restricting breathing. Thus, it effectively enables an infant's infantile exercises. The air in the present invention can be replaced by other buoyant materials.

What is claimed is:

1. A swim ring for an infant being an inflated circular ring, wherein the circular ring comprises an outer ring that is thicker than the inner ring, being a two-part structure, having two chambers and two air holes formed in the outer ring; and an inner ring having an inner air chamber communicating with one of the chambers in the outer ring;

a cut is formed through the inner ring and the outer ring;

a fastener holds the cut in the inner ring and the outer ring; and a recess to hold an infant's chin is formed in the inner ring.

2. The swim ring for an infant as claimed in claim 1, wherein multiple colored balls are inside the outer ring.

3. The swim ring for an infant as claimed in claim 2, wherein a waterproof music player is mounted on the outer ring.

4. The swim ring for an infant as claimed in claim 3, wherein two handles are attached to an outside of the outer ring.

5. The swim ring for an infant as claimed in claim 2, wherein two handles are attached to an outside of the outer ring.

6. The swim ring for an infant as claimed in claim 1, wherein a waterproof music player is mounted on the outer ring.

7. The swim ring for an infant as claimed in claim 6, wherein two handles are attached to an outside of the outer ring.

8. The swim ring for an infant as claimed in claim 1, wherein two handles are attached to an outside of the outer ring.

* * * * *